United States Patent [19]

Kunig

[11] 4,344,208

[45] Aug. 17, 1982

[54] NEEDLE PLATE FOR NEEDLE BARS OF NEEDLE BAR DRAWING DEVICES

[75] Inventor: Helmut Kunig, Lübeck, Fed. Rep. of Germany

[73] Assignee: Nordischer Maschinenbau Rud. Baader GmbH & Co. KG, Lübeck, Fed. Rep. of Germany

[21] Appl. No.: 171,190

[22] Filed: Jul. 22, 1980

[30] Foreign Application Priority Data

Aug. 25, 1979 [DE] Fed. Rep. of Germany ..... 2934431

[51] Int. Cl.[3] ..... D01G 19/00; D01G 5/14

[52] U.S. Cl. ..... 19/129 R

[58] Field of Search ..... 19/129 R; 28/115

[56] References Cited

U.S. PATENT DOCUMENTS

| | | | |
|---|---|---|---|
| 113,825 | 4/1871 | Weiler | 19/129 R |
| 2,391,560 | 12/1945 | Foster | 28/115 |
| 2,927,347 | 3/1960 | Köhler | 19/129 R |
| 3,601,861 | 8/1971 | Moriwaki | 19/129 R |

FOREIGN PATENT DOCUMENTS

| | | | |
|---|---|---|---|
| 2153493 | 5/1973 | Fed. Rep. of Germany | 19/129 R |
| 1582576 | 9/1967 | France | 19/129 R |
| 442089 | 1/1968 | Switzerland | 19/129 R |
| 497562 | 11/1970 | Switzerland . | |

*Primary Examiner*—Louis Rimrodt
*Attorney, Agent, or Firm*—Edward F. Levy

[57] ABSTRACT

A needle rod for use in needle bar drawing devices, also termed and known as gill boxes is proposed to comprise needle plate segments (7) which are releasably connectable to a carrier bar (2) and which have a profile of T, Z or Y shaped cross-section. The needles (12) are bent approximately at right angles in the region of their shafts (13) and are securely connected to the carrier plate (8) not only with the free ends (14) of the same but also with the parts of the shafts (13) directed towards the needle tip (15).

9 Claims, 5 Drawing Figures

Fig. 1
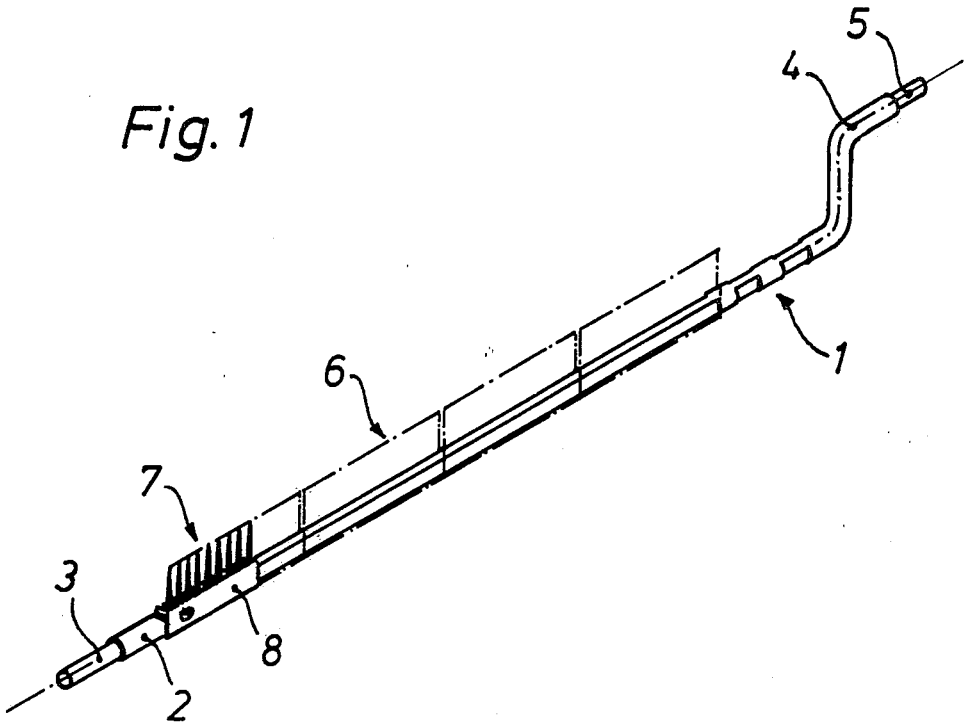
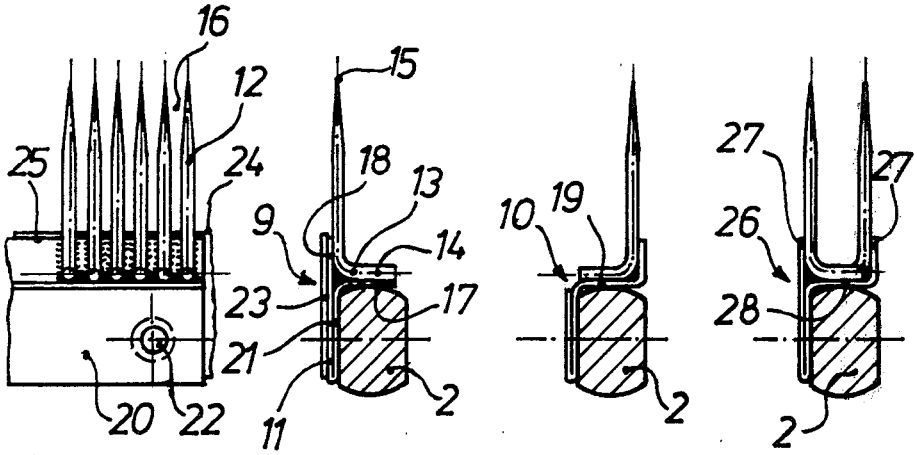
Fig.3 Fig.2 Fig.4 Fig.5

NEEDLE PLATE FOR NEEDLE BARS OF NEEDLE BAR DRAWING DEVICES

BACKGROUND OF THE INVENTION

1. Field of the Invention

The invention relates to a needle bar, suitable for use in needle fields of textile machines, in particular drawing or gill fields of needle bar drawers, also termed gill boxes and, in particular, concerns needle bars with at least one needle rod secured to a carrier bar of the needle bar, this needle bar including a profile-like angled carrier rod and at least one row of needles, the shafts of which are bonded to at least one limb of the angled profile of the carrier rod by soldering, welding, or sticking.

2. Description of Prior Art

Such needle bars have long been successful in operation since excellent drawing results are attainable with their help. The known constructions have, however, disadvantages which render the use of differently constructed needle bars desirable. These disadvantages reside in particular in that their repair is very complicated when needles break out and necessitates special devices of the user so that commonly the whole needle bar must be exchanged and the faulty one repaired at the supplier's. Means have therefore been sought to be able to exchange or replace individual needles or groups of needles and to make this feasible on the spot. The route to this end entailed the use of needle strips which are generally manufactured by the connection together of the shafts of the individual needles preferably by welding or by means of steel wires or bands, and which for their part are connected to the carrier bar by means of sticking, soldering, welding, rivetting or screwing.

From CH-PS No. 497562 further needle rods are known which comprise profile-like bent carrier plates which have a U shaped pocket for the reception of the needles. The spacing of the needle tips corresponds to the shaft thickness of the needles so that the needle shafts lie in close contact adjacent to one another. In the region of their shafts the needles are connected by means of a bonding agent, e.g. a solder mass, to each other and to the carrier rod. The latter is provided with a portion extending above the shaft ends which is constructed as a securing flap serving to secure the needle rod to the needle carrier, e.g. a needle bar.

With needle rods of this construction it is possible to produce a needle field with a very close bar spacing in which the exchange of individual needle rods is facilitated. There are, however, some disadvantages which impair their use in the drawing field resp. gill area of needle bar drawers resp. gill boxes. Thus the U shaped enclosure of the needle shafts results in the individual needles not coming free from their mounting when unavoidably over-stressed, as is desired, since otherwise there is the danger of the bending or the twisting of the carrier bar with the consequence of the destruction of whole needle field regions on the appearance of locally occuring load peaks. Furthermore, the necessity of accommodating the entire length of the needles above the securing flap brings about a moment acting as a torsional stress on the carrier bar and the needle plate which leads to a lasting increased loading of the needle bar. Additionally the suggested needle plate has a very low reactive moment in the direction of stressing of the needles so that these must be connected to the carrier bar either absolutely flat or by means of closely spaced connecting elements, which in the latter case again leads to the weakening of the carrier bar.

3. Object of the Invention

The main objects of the invention are therefore to be found in providing for a needle rod which uses, in a simple manner, wholly or partially exchangeable needle carrying elements of high stress bearing ability to which the needles are so anchored that they reliably come free from the needle assembly at a defined loading lying in the region of their breaking strength extending transverse to the needle rod.

BRIEF SUMMARY OF THE INVENTION

These objects are solved in accordance with the present invention in that the needles are bent approximately at right angles in the region of their shafts and are connected to appropriate limbs of the profile of the carrier rod not only with the free ends of their shafts but also with the parts of the same directed towards the needle tip. The advantages achieved thereby reside, in particular, in that an anchoring of the needles is made possible which permits their desired release from the needle assembly at loadings which lie in the region of the breaking strength of the needles and that simultaneously a needle rod of high bending strength is provided which may be used in a needle field of close bar spacing.

In accordance with a further embodiment of the invention the profile of the needle plate has a T or Z cross-section, with a middle web and a side web of which the shafts of the needles are connected. Thus a space saving arrangement of the needle rod on the flank of the carrier bar may be provided enabling a close spacing of the needle bars.

According to a further embodiment of the invention the profile of the needle rod may have a Y cross-section whereby each of two limbs parallel to one another supports a row of needles which in each case are connected with these limbs with their parts of their shafts directed towards the needle tips and to an intermediate web connecting the two limbs with the free ends of the shafts. Thus a double number of needles may be accommodated on a needle rod with the possibility of halving the bar spacing in a needle field composed of them.

Preferably the needle rod comprises a rolled or drawn profile of metallic working material. This enables the needle rods to be manufactured in a particularly simple and economical manner.

In order to permit an economical fabrication of very light needle rods the needle rod may comprise a plastics profile which can be manufactured in an extrusion or injection moulding process.

To render possible a mounting or replacing of the needle rods in an easy manner, a fixing limb of the respective profile of the carrier rod may be provided with apertures for fixing the needle rod to the carrier bar.

In accordance with a further embodiment the needle rod of each needle bar is formed from a number of interconnected needle rod segments. Thus there is the possibility of removing defects in the form of individual needle breakages by merely exchanging the relevant needle plate segments.

In accordance with yet another embodiment the joints between the needle rod segments are covered by means of a strip of metallic working material to be fastened with them to the carrier bar, the upper edge of the same extending a little above the edge of the limbs of the carrier plate supporting the shafts of the needles at their parts directed towards the needle tip. Thus an impairment of the fibres running through the needle field by reason of the needle rod segments is avoided.

BRIEF DESCRIPTION OF THE DRAWINGS

Other and further objects of the present invention will be apparent from the following description and claims and are illustrated in the accompanying schematic drawings, which, by way of illustration, show preferred embodiments of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims.

In the drawings:

FIG. 1 is a needle bar in accordance with the invention in an axonometric representation, FIG. 2 is a cross-section through a carrier bar with a needle rod provided with a carrier rod with a T cross-section, FIG. 3 is a fragmentary side view in association with the cross-section from FIG. 2 without a carrier bar, FIG. 4 is a cross-section through a carrier bar with a needle rod provided with a carrier rod with Z cross-section, and FIG. 5 is a cross-section through a carrier bar with a needle rod provided with a carrier rod with Y cross-section which is set with a double row of needles.

DETAILED DESCRIPTION OF THE PREFERRED EMBODIMENT

As may be seen in FIG. 1 a needle bar 1 of a needle or gill field which is not shown of a needle bar drawer or gill box comprises a carrier bar 2 of which one end is constructed as a bearing pin 3 and of which the other end is bent to a crank 4 whose crank pin 5 parallel to the carrier bar 2 can carry a control roller which is not shown. In its central portion the carrier bar 2 affords opposed longitudinally extending surfaces to one of which a plurality of interconnected needle rod segments 7 are secured in a suitable manner which form a needle rod 8 of a thin metal strip 11 of steel or common metal fabricated by bending or folding, which can have a T cross-section 9 in accordance with FIG. 2, a Z cross-section 10 in accordance with FIG. 4 or a Y cross-section according to FIG. 5. The carrier rod 8 is set with needles 12 separated from each other by a gap 16, which in the region of their shafts 13 are bent at right-angles and which are connected to the carrier rod 8 not only with the free ends 14 of their shafts 13 but also with the parts of the shafts 13 directed towards the needle tips 15 by means of a metallic solder or by sticking. Thus in accordance with the structure of FIG. 2 the needles 12 are so arranged that their shafts 13 are simultaneously connected to a middle web 17 and a side web 18 and in accordance with FIG. 4 with an intermediate web 19 and a side web 18. In each case a securing limb 20 of the carrier rods 8 is, for reasons of the better bending resistance, constructed of a double layer 21 of the metal strip 11 and provided with apertures 22 for its securement to the carrier bar. With this securement a strip 23 of metallic working material can be clamped under with it so that its upper edge 24 extends a little above an upper edge 25 of the side web 18 of the carrier rod 8 connected to the shafts 13 of the needles 12. In this manner the joints between the needle rod segments 7 are covered so that they do not come into contact with the moving threads.

In a construction of the carrier rod 8 in accordance with FIG. 5 there is the possibility of the accommodation of two rows of needles 12. For this purpose the carrier rod 8 has a Y cross-section 26. Each two adjacent needles 12 are thus connected to a respective one of parallel limbs 27 of the Y cross-section 26 with the parts of their shafts 13 directed towards the needle tips 15, whilst the free ends 14 of their shafts 13 lying closely together are secured to an intermediate web 28.

What I claim as my invention and desire to secure by Letters Patent is:

1. Needle rod for mounting on needle bars of needle bar drawing devices, said needle rod including a carrier rod, said carrier rod having a first surface and a second surface, said second surface extending substantially perpendicular to said first surface, and at least one row of needles, said needles each having a shaft, a free end and a tip, said shaft comprising a first portion terminating in said free end and a second portion terminating in said tip, said first portion extending substantially perpendicular to said second portion whereby said shaft includes a substantially right angle bend, at least a part of the length of each of said first and second portions of said shafts being connected to a respective one of said first and second surfaces of said carrier rod, said carrier rod being formed with a middle web and two side webs, the first and second surfaces of said carrier rod being afforded by said middle web and one of said side webs, the other of said two side webs constituting a limb for securing said needle rod to said needle bars.

2. Needle rod as claimed in claim 1 wherein said carrier rod is of substantially T cross-section, said T cross-section providing said middle web and said two side webs, one of said side webs extending perpendicularly in one direction from said middle web, and the other side web extending perpendicularly in in the opposite direction from said middle web.

3. Needle rod as claimed in claim 1 wherein said carrier rod is of substantially Z cross-section providing said middle web and said two side webs.

4. Needle rod as claimed in claim 1 wherein said carrier rod affords a third surface, said third surface extending substantially parallel to said first surface, said carrier rod being of substantially Y cross-section, said Y cross-section having a base leg and a head, said head affording said first, second and third surfaces, said needle rod including first and second rows of needles, said first and second portions of said shafts of said first row of needles being connected to said second and first surfaces of said carrier rod respectively and said first and second portions of said shafts of said second row of said needles being connected to said second and third surfaces of said carrier rod, said base leg of said carrier rod constituting said securing limb for securing said needle rod to said carrier bar.

5. Needle rod as claimed in any one of claims 1 to 4 wherein said carrier rod comprises a rolled or drawn metallic profile.

6. Needle rod as claimed in any one of claims 1 to 4 wherein said carrier rod comprises an extruded or injection moulded plastics profile.

7. Needle rod as claimed in any one of claims 2 to 4 wherein said securing limb is formed with apertures for securing said needle rod to said needle bar.

8. Needle rod as claimed in any one of claims 1 to 4 wherein said needle rod comprises a plurality of interconnected needle rod segments.

9. Needle rod as claimed in claim 8 wherein said joints are present between said needle rod segments, said joints being covered by a metallic strip, said needle rod and said metallic strip being connected to said needle bar, said metallic strip and said first surface of said carrier rod having a respective upper edge, said upper edge of said metallic strip extending a predetermined distance above said upper edge of said first surface.

* * * * *